United States Patent [19]

Dakroub

[11] 4,246,517

[45] Jan. 20, 1981

[54] SCR LAMP SUPPLY

[75] Inventor: Housan Dakroub, Dearborn, Mich.

[73] Assignee: Burroughs Corporation, Detroit, Mich.

[21] Appl. No.: 69,562

[22] Filed: Aug. 24, 1979

[51] Int. Cl.[3] ..... H05B 39/08

[52] U.S. Cl. ..... 315/307; 307/297; 307/304; 323/22 SC; 355/69

[58] Field of Search ..... 315/194, 199, 307, 311; 355/69; 307/252 J, 252 N, 252 P, 297, 304; 323/22 SC

[56] References Cited

U.S. PATENT DOCUMENTS 3,836,839 9/1974 Becky ..... 323/22 SC 4,127,783 11/1978 Alaspa ..... 307/297

4,163,161 7/1979 Walker ..... 307/297

*Primary Examiner*—Eugene R. LaRoche

*Attorney, Agent, or Firm*—Charles E. Quarton; Kevin R. Peterson

[57] ABSTRACT

A silicon controlled rectifier (SCR) lamp supply circuit for controlling the amount of rectified voltage delivered to illumination lamps in a document image capturing system includes electronic components for linearizing the transfer function of the circuit to reduce complexity and promote operating stability. The circuit delivers an output voltage to the illumination lamps to within 0.1 volt of a chosen voltage for the lamps and quickly responds to changes in load voltage demand.

8 Claims, 1 Drawing Figure

CONTROL CIRCUIT

FIG. 1. CONTROL CIRCUIT
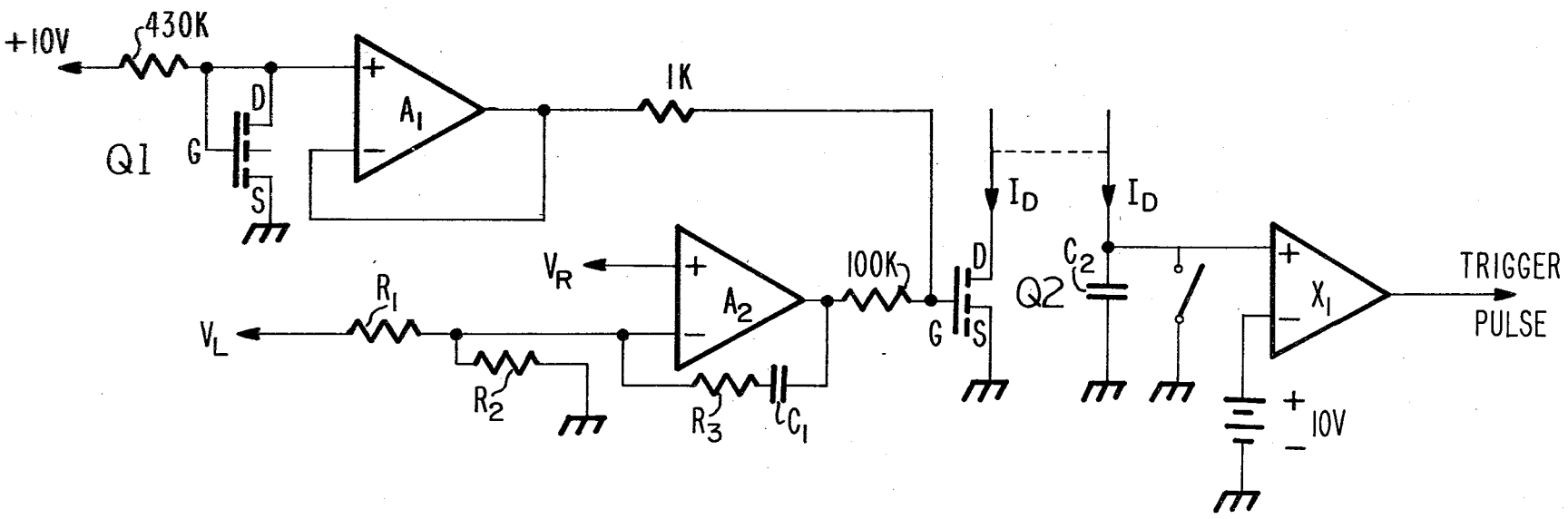

SCR LAMP SUPPLY

BACKGROUND OF THE INVENTION

1. Field of the Invention

This invention relates to a silicon controlled rectifier lamp supply circuit for controlling the amount of voltage delivered to illuminate lamps in a document image capturing system.

2. Description of the Prior Art

In the past, voltage supplies for illumination lamps were able to maintain an output voltage within 1–2 volts of a predetermined voltage level. Such deviations were acceptable for microfilm documentation of information, but systems using charge coupled devices (CCD) for registering document reflectances require more stable voltage supplies to maintain uniform illumination.

Prior systems recovered to their predetermined voltage levels after changes in load voltage demands within approximately 100 milliseconds. However, such a time lag with newer CCD sensitivities results in changing illumination levels which adversely affect the accuracy of the information sensing elements. Therefore, the invention provides for a faster response time of 30 milliseconds so light output changes are minimized.

In the patent by Raymond Becky entitled, "Controlled Apparatus for Silicon Controlled Rectifiers," U.S. Pat. No. 3,836,839 issued Sept. 17, 1974, the circuit is subject to instability and its transfer function may become nonlinear due to the inclusion of an adjustable feedback potentiometer at the circuit's output. Setting a reference voltage to which the output voltage is regulated involves applying an input voltage to the circuit and adjusting the potentiometer. The applicant's circuit, however, only requires the input of a predetermined voltage to the positive terminal of an operational amplifier to establish a reference voltage.

The advantages gained from the applicant's invention over the patented circuit are precision supply voltage regulation to the illumination lamps, increased operational stability since fixed components in a closed, negative feedback loop need not be continually adjusted for a chosen reference voltage, and a faster response to changing load voltage demands.

SUMMARY OF THE INVENTION

A silicon controlled rectifier (SCR) lamp supply circuit is used to control the amount of rectified voltage delivered to illulmination lamps in a document image capturing system. The circuit includes metal-oxide semiconductor field-effect transistors (MOSFETs) having a gate to source voltage sinusoidally related to the transistor's drain current and an output voltage cosinusoidally related to the SCR controlled input voltage to be triggered for powering the illumination lamps. These MOSFETs linearize the transfer function of the lamp supply circuit to achieve more reliable control and reduce circuit complexities.

To deliver a desired voltage to the illumination lamps, a control operational amplifier detects load voltage deviations from a predetermined reference voltage. Any detected difference in voltage causes a first MOSFET to trigger the SCR supplied voltage to the circuit at a necessary angle to restore the equality of the load and reference voltages. A second MOSFET, compositionally matched with the first MOSFET, is included to minimize the effect of temperature variations between the two transistors. The matching allows a bias voltage to be applied to the two MOSFETs so their threshold offset voltages are effectively cancelled and a controlled amount of current can be conducted due to stable MOSFET operation in the region where their gate to source voltage is sinusoidally related to their drain current.

Detected deviations of required load voltages from the predetermined reference voltage are quickly sensed by the control operational amplifier and a stable response is provided by a closed loop, resistor-capacitor negative feedback circuit.

BRIEF DESCRIPTION OF THE DRAWINGS

FIG. 1 depicts the circuit for controlling the voltage of an SCR lamp supply.

DETAILED DESCRIPTION

The applicant's invention will be described with reference to FIG. 1.

To eliminate the characteristic threshold voltage of the circuit's metal-oxide semiconductor field-effect transistors (MOSFETs) $Q_1$ and $Q_2$ (SD5200N, manufactured by Signetics Corporation, P.O. Box 9052, Sunnyvale, California 94086), a positive 10 volt bias is applied to the gate input of $Q_1$. This voltage causes a potential difference of 1–2 volts between the gate and source of $Q_1$ and a current of approximately 0.01 milliamps to flow into the drain of $Q_1$. With these current and voltage levels, $Q_1$ operates in an equilibrium state where its gate to source voltage is sinusoidally related to the drain current.

The 1–2 volts between the gate and source of $Q_1$ also appear across the gate and source of $Q_2$ due to the unity gain and very low output impedence of operational amplifier $A_1$ (LM324, manufactured by National Semiconductor Corporation, 2900 Semiconductor Drive, Santa Clara, California 95051). Consequently, the same value of drain current flowing in $Q_1$ also flows in $Q_2$ so that $Q_2$ exhibits the sinusoidal relationship as $Q_1$.

Some advantages of operating above the MOSFET voltage threshold include the available predictability and control which accompanies the known relationship between the gate to source voltage and the drain current. This predictability is manifested by the stable operation of $Q_1$ and $Q_2$ above the threshold level. Furthermore, to promote uniform operation and minimize the effect of temperature variations between the two transistors, $Q_1$ and $Q_2$ are compositionally matched by being manufactured on the same silicon substrate.

The reference voltage $V_R$ which determines the amount of rectified voltage supplied to the illumination lamps is applied to the noninverting input of operational amplifier $A_2$ (LM324, manufactured by National Semiconductor Corporation). To detect a portion of the lamp voltage $V_L$ at the inverting input of $A_2$, a voltage divider resistor network of $R_1$ and $R_2$ is provided. Resistor $R_3$ and capacitor $C_1$ form a negative feedback closed loop for $A_2$ to stabilize the response of $A_2$ to the detected $V_L$ deviations from $V_R$.

As the detected voltage demand of the illumination lamps varies from $V_R$, the voltage difference appears at the output of $A_2$. The gate of $Q_2$, connected between the 100 Kohm resistor at the output of $A_2$ and the 1 Kohm output resistor of $A_1$, senses 0.01 of the detected $V_L$ and $V_R$ difference. This difference will increase or decrease the gate to source voltage of $Q_2$ and thereby affect the amount of drain current into $Q_2$. However, the gate to source voltage increase or decrease is kept small by the output resistors' ratio so that $Q_2$ is not forced to operate below its threshold voltage and become unstable.

The drain of $Q_2$ is linked to the noninverting input of a 10 volt comparator $X_1$ (LM339, manufactured by National Semiconductor Corporation). This comparator emits a trigger pulse to the rectified supply voltage source powering the illumination lamps when the drain current of $Q_2$, flowing through capacitor $C_2$, charges $C_2$ to 10 volts. The instant at which this 10 volts is attained determines the angle at which the supply voltage is triggered and consequently the magnitude of voltage delivered to the lamps. The sinusoidal relationship between the MOSFET's gate to source voltage and the drain current, combined with cosine characteristic of the rectified supply voltage, yields a linear transfer function for the circuit allowing precise voltage control.

What is claimed is:

1. A silicon controlled rectifier lamp supply circuit for controlling the voltage delivered to illumination lamps in a document image capturing system comprising:

means for sensing load voltage deviations from a reference voltage;

means for stabilizing the response of the means for sensing load voltage deviations from the reference voltage;

an AC voltage supply having a cosinusoidal output for powering the illumination lamps;

means for triggering the AC voltage supply to deliver a precise voltage to the illumination lamps; and means, having an output current sinusoidally related to the input voltage for linearly controlling the means for triggering the AC voltage supply in response to the means for sensing load voltage deviations from a reference voltage.

2. The invention of claim 1, wherein the means for sensing load voltage deviations from a reference voltage comprises an operational amplifier biased by the reference voltage.

3. The invention of claim 2, wherein the means for stabilizing the response of the means for sensing load voltage deviations from the reference voltage comprises a negative feedback path for the operational amplifier.

4. The invention of claim 2, wherein the means for stabilizing the response of the means for sensing load voltage deviations from the reference voltage comprises a negative feedback path, having a maximum response time of about 30 milliseconds to load voltage deviations from the reference voltage, for the operational amplifier.

5. The invention of claim 1, wherein the means for triggering the AC voltage supply to deliver a precise voltage to the illumination lamps comprises:

a voltage storage element charged with current from the means for linearly controlling the means for triggering the AC voltage supply; and means for comparing the voltage on the voltage storage element with the reference voltage, the means for comparing generating an output to the AC voltage supply when the voltage on the voltage storage element equals the reference voltage.

6. The invention of claim 1, wherein the means for linearly controlling the means for triggering the AC voltage supply comprises:

a plurality of metal-oxide semiconductor field-effect transistors having a gate to source voltage sinusoidally related to the drain current of the transistors; and a voltage supply to maintain the sinusoidal relationship between the input voltage and output current of the transistors.

7. The invention of claim 6, wherein the plurality of metal-oxide semiconductor field-effect transistors comprises a pair of matched metal-oxide semiconductor field-effect transistors.

8. The invention of claim 7, wherein the means for linearly controlling the means for triggering the AC voltage supply comprises a plurality of metal-oxide semiconductor field-effect transistors for maintaining the load voltage within about 0.1 volts of a reference voltage.

* * * * *